United States Patent [19]

Wertz

[11] 4,326,835

[45] Apr. 27, 1982

[54] BLADE PLATFORM SEAL FOR CERAMIC/METAL ROTOR ASSEMBLY

[75] Inventor: John L. Wertz, Indianapolis, Ind.

[73] Assignee: General Motors Corporation, Detroit, Mich.

[21] Appl. No.: 89,179

[22] Filed: Oct. 29, 1979

[51] Int. Cl.[3] ..... F01D 5/30

[52] U.S. Cl. ..... 416/193 A; 416/241 B

[58] Field of Search ..... 416/193 A, 241 B

[56] References Cited

U.S. PATENT DOCUMENTS

| | | | |
|---|---|---|---|
| 3,077,811 | 2/1963 | Moore | 416/193 A X |
| 3,295,825 | 1/1963 | Hall | 416/193 A X |
| 3,318,573 | 5/1967 | Matsuki et al. | 416/193 A X |
| 3,709,631 | 1/1973 | Karstensen et al. | 416/193 A X |
| 3,752,598 | 8/1973 | Bowers et al. | 416/193 A X |
| 3,850,546 | 11/1974 | Mason | 416/193 A X |
| 3,918,842 | 11/1975 | Longley et al. | 416/193 A X |
| 3,972,645 | 8/1976 | Kasprow | 416/193 A X |
| 4,111,603 | 9/1978 | Stahl | 416/193 A X |
| 4,177,013 | 12/1979 | Patterson et al. | 416/193 A |
| 4,183,720 | 1/1980 | Brantley | 416/193 A |

FOREIGN PATENT DOCUMENTS

| | | | |
|---|---|---|---|
| 1259750 | 1/1972 | United Kingdom | 416/193 A |

*Primary Examiner*—Everette A. Powell, Jr.
*Attorney, Agent, or Firm*—J. C. Evans

[57] ABSTRACT

A combination ceramic and metal turbine rotor for use in high temperature gas turbine engines includes a metal rotor disc having a rim with a plurality of circumferentially spaced blade root retention slots therein to receive a plurality of ceramic blades, each including side platform segments thereon and a dovetail configured root slidably received in one of the slots. Adjacent ones of the platform segments including edge portions thereon closely spaced when the blades are assembled to form expansion gaps in an annular flow surface for gas passage through the blades and wherein the assembly further includes a plurality of unitary seal members on the rotor connected to its rim and each including a plurality of spaced, axially extending, flexible fingers that underlie and conform to the edge portions of the platform segments and which are operative at turbine operating temperatures and speeds to distribute loading on the platform segments as the fingers are seated against the underside of the blade platforms to seal the gaps without undesirably stressing thin web ceramic sections of the platform.

1 Claim, 5 Drawing Figures

BLADE PLATFORM SEAL FOR CERAMIC/METAL ROTOR ASSEMBLY

This invention relates to gas turbine engine rotor assemblies and more particularly to dual property turbine rotors including ceramic blade components seated in a metal disc and to means for sealing between unitary cast blade segments at circumferential gaps formed therebetween when the ceramic blades are fastened to a rim portion of the metal disc of the rotor assembly.

The invention described herein was made in the performance of work under a NASA contract funded by the Department of Energy of The United States Government.

Separate turbine rotor blade components connected to the rim of a turbine disc at retention slots therein have gaps formed between platform edges on the blades.

Such arrangements require modified support systems for locating the seal components with respect to the gaps and in some cases have required redesign of seal plate designs that connect separate blade components to the rim of the rotor disc.

An object of the present invention is to provide an improved blade platform gap seal assembly which employs a seal member that is cantilevered from the rotor end face and that is configured to have a plurality of integral, thin sheet metal fingers thereon that extend the full axial length of platform gaps between unitary ceramic blade components connected to the rim of a metal rotor disc at retention slots therein at a root portion of the blades and wherein each of the cantilevered multi-fingered, seal fingers have a compliancy to reduce load on the blade platforms thereby to minimize localized stress concentrations in the ceramic blade components.

Another object of the present invention is to provide an improved blade platform seal member for sealing platform gaps between separate ceramic blade components that are connected in retention slots in the rim of a metal rotor disc by the provision of means that are connected to the metal rim without requiring changes in a blade connector and seal plate design and wherein the platform seal member includes individual fingers bent at right angles to a connector ring segment; each finger being located in underlying relationship to the platform components of assembled ceramic blades to engage the underside of platform components to seal gaps therebetween without producing undesirable stress build-up in the ceramic components and wherein the seal connector segment is a thin flat segment that can be precisely positioned between blade connector and cover plates and the ceramic blade components when assembled on the rim.

Still another object of the present invention is to provide an improved blade platform seal member for covering platform gaps between individual ones of unitary ceramic blades on a metal disc by provision of a thin sheet ring segment connected to the rotor cover plate and wherein the ring segment is a single photo-etched plate having a plurality of seal fingers formed as integral projections on the ring segment, each underlying a platform gap between a pair of adjacent unitary ceramic blades and wherein each of the fingers are bent at right angles to the mounted ring segment and wherein the ring segment is of a width that can be accommodated between a face of the rotor disc and a cover plate that secures the root portion of the unitary ceramic blade in a retention slot formed in the rim of the metal disc and wherein each of the fingers flex to seal the gaps while attenuating the seal load across conformed surfaces on the underside of platform edges thereby to prevent stress concentration in the ceramic material of the blade components.

Further objects and advantages of the present invention will be apparent from the following description, reference being had to the accompanying drawings wherein a preferred embodiment of the present invention is clearly shown.

Figure 1:
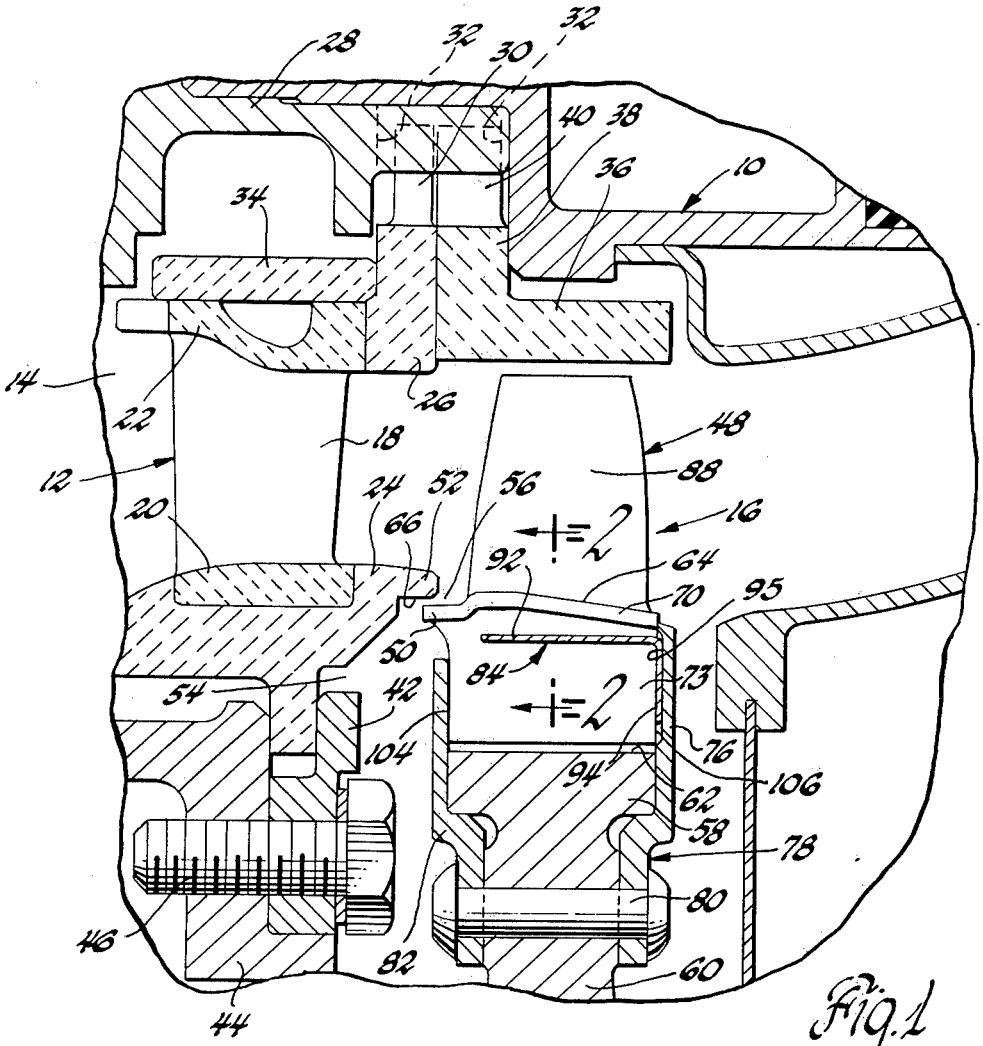
FIG. 1 is a fragmentary, longitudinal sectional view of a turbine rotor assembly including the present invention.

Referring now to FIG. 1, a gas turbine engine hot section 10 is illustrated including a ceramic nozzle vane ring 12 for directing hot motive fluid from a passage 14 from the outlet of a combustor assembly for directing hot gases in the order of 2070° F. and greater through the ceramic nozzle vane ring 12. In the present invention, the nozzle vane ring 12 is a gasifier turbine nozzle for directing the motive fluid to a downstream located gasifier turbine assembly 16 including the present invention.

The gasifier nozzle vane ring 12 includes a plurality of aerodynamically configured nozzle vanes 18 each including a small area load reacting foot 20 at the base thereof and a like small area load reacting foot 22 at the top thereof connected respectively to an inner vane support ring 24 and an outer blade support ring 26, both of ceramic material. The outer vane support ring 26 is cross keyed to an outer metal support ring 28 by slots 30 on the ring 26 that receives the tabs 32 of the metal ring 28. A ceramic vane retaining ring 34 slips over the outer ceramic vane support ring 26 to hold the individual vanes 18 therein. A gasifier rotor ceramic tip shroud 36 is centered and has a flange 38 located with respect to the outer metal support ring 28 by cross key slots 40 thereon located at circumferentially spaced points therearound and which receive retention tabs 32 formed in the ring 28. The inner vane support ring 24 is held in place by a retention plate 42 secured to interiorly located inner engine support structure 44 by suitable fastening means including illustrated bolts 46.

The aforedescribed ceramic nozzle vane and support system directs high temperature motive fluid to a gasifier rotor assembly 16 having a plurality of ceramic blade components 48 of unitary construction. Each of the blade components 48 includes a forward lip 50 thereon underlying a trailing edge 52 of the inner blade support ring 24 to define a forward lip seal for the rotor assembly 16 wherein the pressure in a seal region 54 is maintained slightly greater than the pressure at a lip seal gap 56.

The forward lip seal defined by lip 50 and the trailing edge 52 reduces hot gas mixing to enhance the cooling effect of compressor discharge air within the seal region 54 as it flows therefrom across the attachment between blades 16 and rim 58 to maintain it cooled during hot engine operation.

The forward lip 50 constitutes an extension of a blade platform 64 formed integrally on each of the blade components 48. Lip 50 is machined to provide a rotating seal relationship which overlaps a machined bore 66 in the trailing edge 52 of the inner blade support ring 24 as best shown in FIG. 1.

Figure 2:
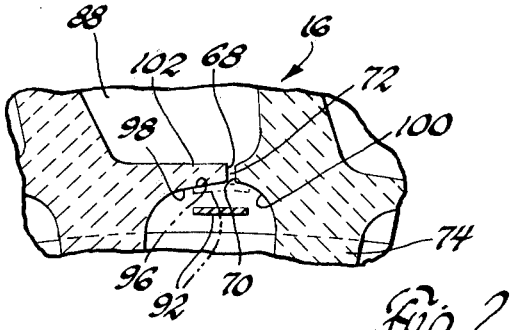
FIG. 2 is a fragmentary vertical sectional view taken along the line 2—2 of FIG. 1 looking in the direction of the arrows.

Each blade platform 64 includes side edges 68, 70 thereon shown in FIG. 2. The side edges 68, 70 are configured to form an expansion gap 72 between each of the individual blade components 48 when it is secured in place within a retention slot 62. More particularly, each of the blade components 48 includes a contoured blade root 73 that is representatively shown as a dovetail configuration which fits into a retention slot 62 of like configuration by sliding it axially of the rotor rim 58. The stalk segment 74 on each of the blades is sealed by a radial extension 76 on a full cover aft retainer plate 78 that is secured by means of riveted pins 80 to the disc 60. The riveted pins 80 further connect a front retainer plate 82 to rim 58.

As shown in FIGS. 1 and 2, the unitary ceramic blades are silicon carbide injection molded that are sintered to shape. One problem in such arrangements is to avoid excessive loading of the ceramic material during rotor operation. Accordingly, attention must be directed to the manner in which the individual unitary ceramic blade components 48 are connected to the metal disc and sealed with respect thereto.

To accomplish both connection and sealing of the individual components without imposition of excessive loading thereon, the present invention includes a thin sheet metal platform seal member 84 that is operative in response to centrifugal loading to seal the gaps 72 to prevent excessive loss of coolant through the gaps into the motive flow through air aerodynamically configured gas flow paths 88 formed between individual airfoil shapes 90 on each of the blade components 48.

Figure 3:
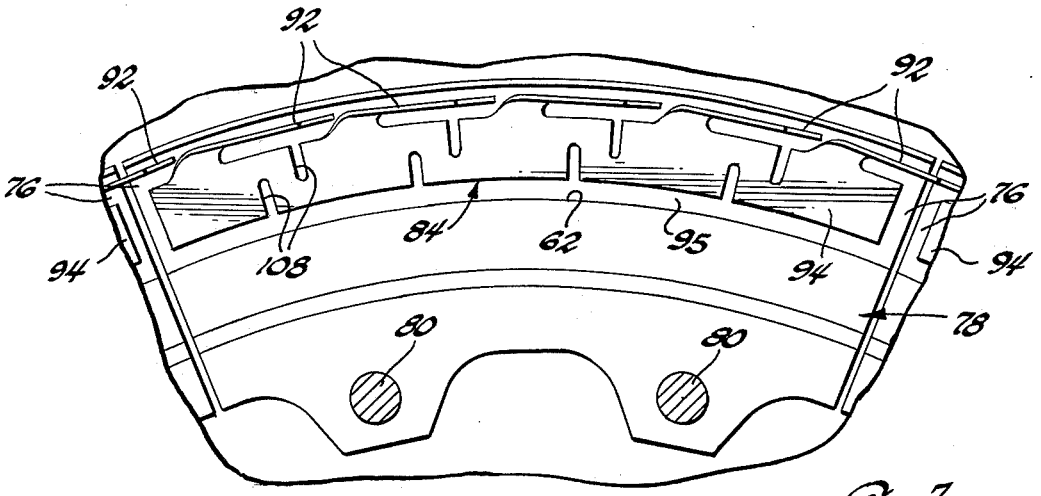
FIG. 3 is an end elevational view of a blade platform seal unit shown in place on the aft retainer plate of the assembly.
Figure 4:
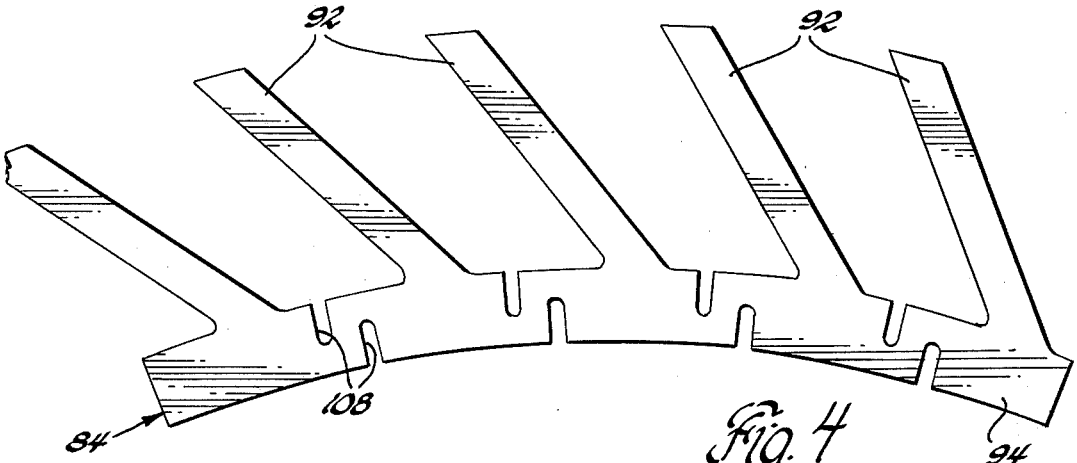
FIG. 4 is an elevational view of the blade platform seal member before finger components thereon are bent.
Figure 5:
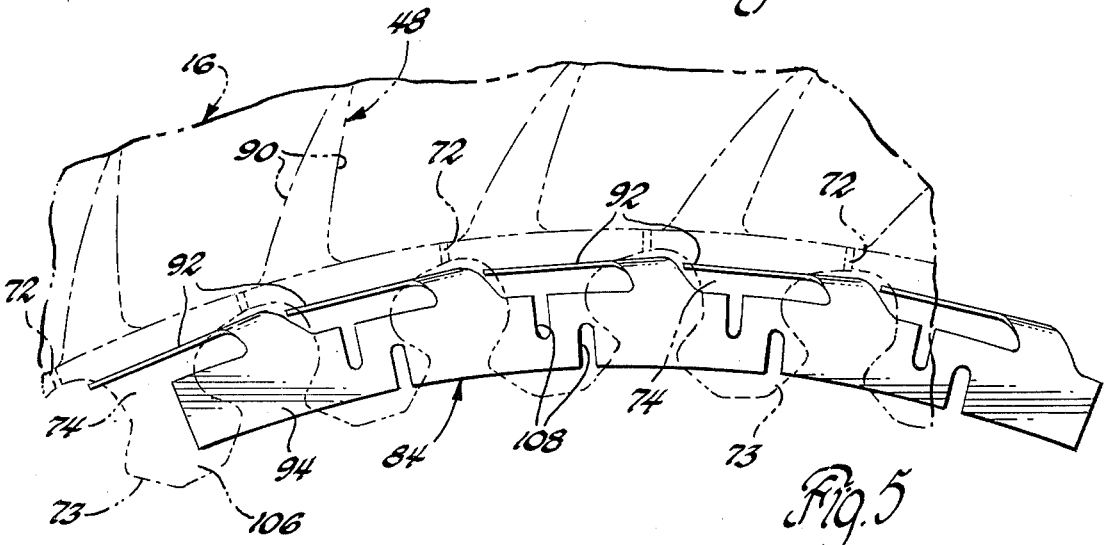
FIG. 5 is an end elevational view of the blade platform seal unit of FIG. 4 with the fingers thereon bent and shown aligned with respect to phantom line illustrated unitary ceramic blade components having blade platform gaps therebetween sealed by the integral fingers of the seal member.

In accordance with the present invention, the platform seal member 84 is a photoetch plate having a thickness of 0.005 inches (0.013 cm) and is formed of HS25 metal. The seal member 84 includes a plurality of integral, spaced fingers 92 thereon bent at right angles to an arcuate ring segment 94 thereon that is cantilever supported. The platform seals static position is shown in FIG. 1. The use of the thin sheet metal platform seal member 84 enables the multiple fingers 92 to be accurately positioned with respect to the assembled blade components 48. Once the fingers are bent at right angles to the ring segment 94 as shown in FIG. 3, the ring segment 94 is spot welded to the inboard surface 95 of the cover plate 78 at the radial extension 76 thereon. This arrangement, in addition to producing a reliable and precisioned positioning of the platform seal member 84 with respect to the connected blade components 48, also enables it to be readily incorporated in blade connection assemblies of the type having fore and aft cover plate connectors without requiring change in the seal plate design or change in disc rim sections at root portions and retention slots therein.

The fingers 92 each extend the full axial length of the interplatform gaps 72 and have a convex outer surface 96 formed thereon along the axial extent of each of the fingers 92 which conforms to concave surface segments 98, 100 on the respective side edges 68, 70 of the blade platforms 64 when in the dotted line sealed position shown in FIG. 2.

When the engine is operated and the strips are centrifugally flexed against the underside of the blade platforms 64 and because of the configuration of the fingers, and the compliancy of the fingers, because of the width and shape thereof, very small additional load is placed on the thin ceramic section 102 at the side edge 68. As a result, no excessive loading of the ceramic material of the unitary blade components 48 is produced as the platform gaps are sealed. Thus, improved thin sheet metal platform seal member 84 is readily positioned in existing turbine rotor configurations and does not require changes in desired ceramic blade sections to accommodate for the seal loadings thereon.

In the illustrated arrangement, the fingers 92 when centrifugally loaded against the blade platforms, as shown, assure coolant flow with respect to the forward and aft disc faces 104, 106 and platform gap leakage is reduced from 2.26% of this flow to less than 0.2% by use of the improved seal member configuration of the present invention.

As illustrated in FIG. 3, each of the aft retainer plates 78 has an arcuate form with an included angle slightly greater than that of the arcuate ring segment 94 on each of the members 84 as shown in FIG. 3. Moreover, the segment 94 has a plurality of stress relief slots 108 therein to accommodate for changes in temperatures between a cold running static position and a hot running dynamic condition of operation of the gasifier turbine rotor illustrated in FIG. 1.

By virtue of the arrangement, common dovetail geometries can be retained and, because thin section platforms can be maintained, blade centrifugal loading and inertial loading on the attachment points between the blade components 48 and the retention slot 62 can be controlled to further eliminate excess stress build-up in cross sections of the ceramic blade components 48.

While the embodiments of the present invention, as herein disclosed, constitute a preferred form, it is to be understood that other forms might be adopted.

The embodiments of the invention in which an exclusive property or privilege is claimed are defined as follows:

1. In a high temperature gas turbine engine ceramic and metal turbine rotor assembly of the type including a metal rotor disc having a rim with a plurality of circumferentially spaced retention slots therein and end faces thereon, and a plurality of ceramic blades, each blade including side platform segments thereon, a blade stalk and a dependent dovetail configured root slidably received in one of said slots, adjacent ones of said platform segments including edge portions thereon closely spaced when said blades are assembled on said disc to form a substantially closed bottom surface for gas flow through said blades, an improved platform seal assembly comprising a plurality of seal members each having a flat ring segment and a plurality of integral fingers disposed generally at 90° to the plane of said ring segment, each of said seal members being fabricated from a high temperature resistant metal and being on the order of 0.005 inches in thickness so that each of said fingers is highly flexible yet light in weight, a plurality of blade connector plates corresponding in number to the number of said seal members and adapted for disposition on one of said rotor disc end faces, means rigidly attaching respective ones of said flat ring segments to corresponding ones of said blade connector plates, and means rigidly attaching each of said connector plates to said rotor disc with said ring segments captured between said rotor and said connector plate thereby to seal between said blade stalks to prevent gas bypass therebetween while accurately positioning each of said fingers beneath said closely spaced edge portions of said platform segments so that said fingers overlap a gap found between said platform segments, said fingers being responsive to rotation of said disc to be centrifugally displaced and flexed against the underside of said platform segments to distribute seal loads at the edge portions thereon to prevent stress concentrations at the platform while sealing said gap therebetween so as to prevent gas bypass through said flow path bottom during operation of the gas turbine engine.

* * * * *